US010490127B2

(12) United States Patent
Lee et al.

(10) Patent No.: US 10,490,127 B2
(45) Date of Patent: Nov. 26, 2019

(54) ORGANIC LIGHT EMITTING DISPLAY DEVICE AND DRIVING METHOD THEREOF

(71) Applicant: Samsung Display Co., Ltd., Yongin-si, Gyeonggi-do (KR)

(72) Inventors: Wook Lee, Yongin-si (KR); Sung Hwan Kim, Yongin-si (KR); Jeong Hwan Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 157 days.

(21) Appl. No.: 15/644,289

(22) Filed: Jul. 7, 2017

(65) Prior Publication Data

US 2018/0012543 A1 Jan. 11, 2018

(30) Foreign Application Priority Data

Jul. 7, 2016 (KR) ..... 10-2016-0086167

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3266* (2013.01); *G09G 3/3275* (2013.01); *G09G 5/393* (2013.01); *G09G 2300/0814* (2013.01); *G09G 2300/0819* (2013.01); *G09G 2300/0828* (2013.01); *G09G 2300/0842* (2013.01); *G09G 2310/027* (2013.01); *G09G 2310/0286* (2013.01); *G09G 2310/0291* (2013.01); *G09G 2310/0294* (2013.01); *G09G 2310/08* (2013.01);
(Continued)

(58) Field of Classification Search
CPC .. G09G 3/3233; G09G 3/3266; G09G 3/3275; G09G 5/393
See application file for complete search history.

(56) References Cited

U.S. PATENT DOCUMENTS 9,230,472 B2 1/2016 Bae
9,236,011 B2 1/2016 Mizukoshi
(Continued)

FOREIGN PATENT DOCUMENTS

KR 10-2013-0024744 3/2013
KR 10-2014-0137218 12/2014
(Continued)

*Primary Examiner* — Ariel A Balaoing
(74) *Attorney, Agent, or Firm* — Lewis Roca Rothgerber Christie LLP

(57) ABSTRACT

An organic light emitting display device includes one or more pixels connected to scan lines, feedback lines, and data lines, and including driving transistors configured to control an amount of current supplied to organic light emitting diodes, a sensor configured to generate compensation data based on sensing data including deviation information of a driving transistor of the driving transistors and first reference data for a sensing period, a data driver configured to supply a first reference data signal to the data line based on second reference data for the sensing period, and a scan driver configured to supply a scan signal to the scan line, wherein the sensor is configured to generate the compensation data while changing a bit value of the second reference data two or more times during the sensing period.

17 Claims, 9 Drawing Sheets

(51) Int. Cl.
*G09G 3/3275* (2016.01)
*G09G 5/393* (2006.01)

(52) U.S. Cl.
CPC ..... *G09G 2320/0233* (2013.01); *G09G 2320/0295* (2013.01); *G09G 2320/043* (2013.01); *G09G 2320/045* (2013.01); *G09G 2330/02* (2013.01)

(56) References Cited

U.S. PATENT DOCUMENTS 9,343,015 B2 5/2016 Jo
9,491,830 B2 11/2016 Lee
2007/0097041 A1* 5/2007 Park ..... G09G 3/2011 345/77
2007/0120780 A1* 5/2007 Park ..... G09G 3/3291 345/76
2009/0027377 A1* 1/2009 Kwon ..... G09G 3/3233 345/214
2011/0109660 A1* 5/2011 Kim ..... G09G 3/3233 345/690
2011/0210958 A1* 9/2011 Yoo ..... G09G 3/325 345/214
2014/0347332 A1* 11/2014 Lee ..... G09G 3/3233 345/204
2015/0042694 A1* 2/2015 Lee ..... G09G 3/3225 345/690

FOREIGN PATENT DOCUMENTS

KR 10-2014-0137859 12/2014
KR 10-1470688 12/2014
KR 10-2015-0012022 2/2015

* cited by examiner

ORGANIC LIGHT EMITTING DISPLAY DEVICE AND DRIVING METHOD THEREOF

CROSS-REFERENCE TO RELATED APPLICATION

This application claims priority of Korean Patent Application No. 10-2016-0086167, filed on Jul. 7, 2016, in the Korean Intellectual Property Office, the entire content of which is incorporated herein by reference.

BACKGROUND

1. Field

Aspects of embodiments of the present invention relate to an organic light emitting display device and a driving method thereof.

2. Description of the Related Art

With the development of information technology, the importance of display devices has grown, because they serve as a connection medium between a user and information. In line with this, the use of display devices, such as Liquid Crystal Display (LCD) devices and Organic Light Emitting Display (OLED) devices, is growing.

Among the types of display devices, the organic light emitting display device displays an image by using an organic light emitting diode in which light is generated through the recombination of electrons and holes, and has an advantage in that the organic light emitting display device has a high response speed and is driven with low power consumption.

Pixels connected to data lines and scan lines are disposed in a display area of the organic light emitting display device. Each of the pixels includes an organic light emitting diode and a driving transistor controlling the amount of current supplied to the organic light emitting diode.

Here, the driving transistor controls the amount of current supplied to the organic light emitting diode in response to a data signal, and a characteristic thereof is uniformly set. However, the driving transistor deteriorates as time goes on, and the degree of deterioration is differently set according to positions of the pixels in response to a displayed image. In this case, the characteristic of the driving transistor is differently set for each pixel, and thus light with non-uniform brightness may be generated in the pixels in response to the same data signal.

SUMMARY

Aspects of embodiments of the present disclosure are directed to an organic light emitting display device which is capable of displaying an image with substantially uniform brightness, and a driving method thereof.

According to some embodiments of the present disclosure, there is provided an organic light emitting display device including: one or more pixels connected to scan lines, feedback lines, and data lines, and including driving transistors configured to control an amount of current supplied to organic light emitting diodes; a sensor configured to generate compensation data based on sensing data including deviation information of a driving transistor of the driving transistors and first reference data for a sensing period; a data driver configured to supply a first reference data signal to the data line based on second reference data for the sensing period; and a scan driver configured to supply a scan signal to the scan line, wherein the sensor is configured to generate the compensation data while changing a bit value of the second reference data two or more times during the sensing period.

In an embodiment, the compensation data is set with a changed bit value of the second reference data.

In an embodiment, the deviation information of the driving transistor is a voltage applied to the feedback line in response to a current flowing from the driving transistor when the first reference data signal is supplied.

In an embodiment, when the second reference data is changed, a voltage of the first reference data signal is also changed.

In an embodiment, the sensor is configured to change the bit value of the second reference data so that the sensing data corresponds to the first reference data.

In an embodiment, the first reference data is pre-set before being forwarding to the organic light emitting display device.

In an embodiment, a display area includes a plurality of pixels, and the first reference data corresponds to a characteristic of a driving transistor of a pixel positioned at a center of the display area.

In an embodiment, a display area includes a plurality of pixels, and the first reference data corresponds to an average value of characteristics of driving transistors of the pixels.

In an embodiment, the organic light emitting display device further includes a timing controller configured to generate second data by changing a bit value of first data based on the compensation data for a driving period, during which a predetermined image is displayed, the first data being supplied from the outside.

In an embodiment, the scan driver supplies a scan signal with a first width during the sensing period, and supplies a scan signal with a second width smaller than the first width.

In an embodiment, the sensor includes: an analog-digital converter configured to generate the sensing data based on the deviation information of the driving transistor; and a comparator configured to compare the first reference data supplied from the timing controller and the sensing data, and to change the bit value of the second reference data so that the sensing data corresponds to the first reference data.

In an embodiment, the sensor further includes a memory configured to store the first reference data and the compensation data.

In an embodiment, the organic light emitting display device further includes a first switch connected between the feedback line and the sensor, and configured to turn on during the sensing period and to turn off during the driving period.

In an embodiment, the organic light emitting display device further includes a second switch connected between the data driver and the data line, and configured to turn on during the sensing period and the driving period.

In an embodiment, the data driver includes: a shift register configured to generate a sampling signal; a sampling latch configured to store the second reference data in response to the sampling signal; a holding latch configured to receive the second reference data stored in the sampling latch in response to a source output enable signal and to store the received second reference data; and a digital-analog converter configured to generate the first reference data signal by using the second reference data, wherein the sensor is configured to change the bit value of the second reference data stored in the holding latch during the sensing period.

According to some embodiments of the present disclosure, there is provided a method of driving an organic light emitting display device configured to compensate for a characteristic of a driving transistor of a pixel during a sensing period, and to implement a predetermined image during a driving period, wherein, during the sensing period, the method includes: generating a first reference data signal in response to second reference data; supplying the first reference data signal to a driving transistor of a pixel; changing a voltage corresponding to a current flowing from the driving transistor of the pixel to sensing data that is a digital value; comparing the sensing data and the first reference data, and changing a bit value of the second reference data two or more times so that the sensing data corresponds to the first reference data; and storing a changed bit value of the second reference data as compensation data.

In an embodiment, the method further includes changing a bit value of data to be supplied to the pixel based on the compensation data extracted from the driving transistor of the pixel for the driving period.

Accordingly, in some exemplary embodiments of the present disclosure, compensation data, which may be added to or subtracted from data in response to a deviation of a driving transistor, is generated for the sensing period. That is, in some exemplary embodiments of the present disclosure, the compensation data is generated while a voltage of the first reference data signal is controlled for the sensing period, and thus, a circuit configuration for implementing an equation and the like may be omitted.

Further, second data may be generated by changing a bit value of first data supplied from the outside by using the compensation data for the driving period, so that the pixels may display images with uniform brightness.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawings, dimensions may be exaggerated for clarity of illustration.

DETAILED DESCRIPTION

Figure 1:
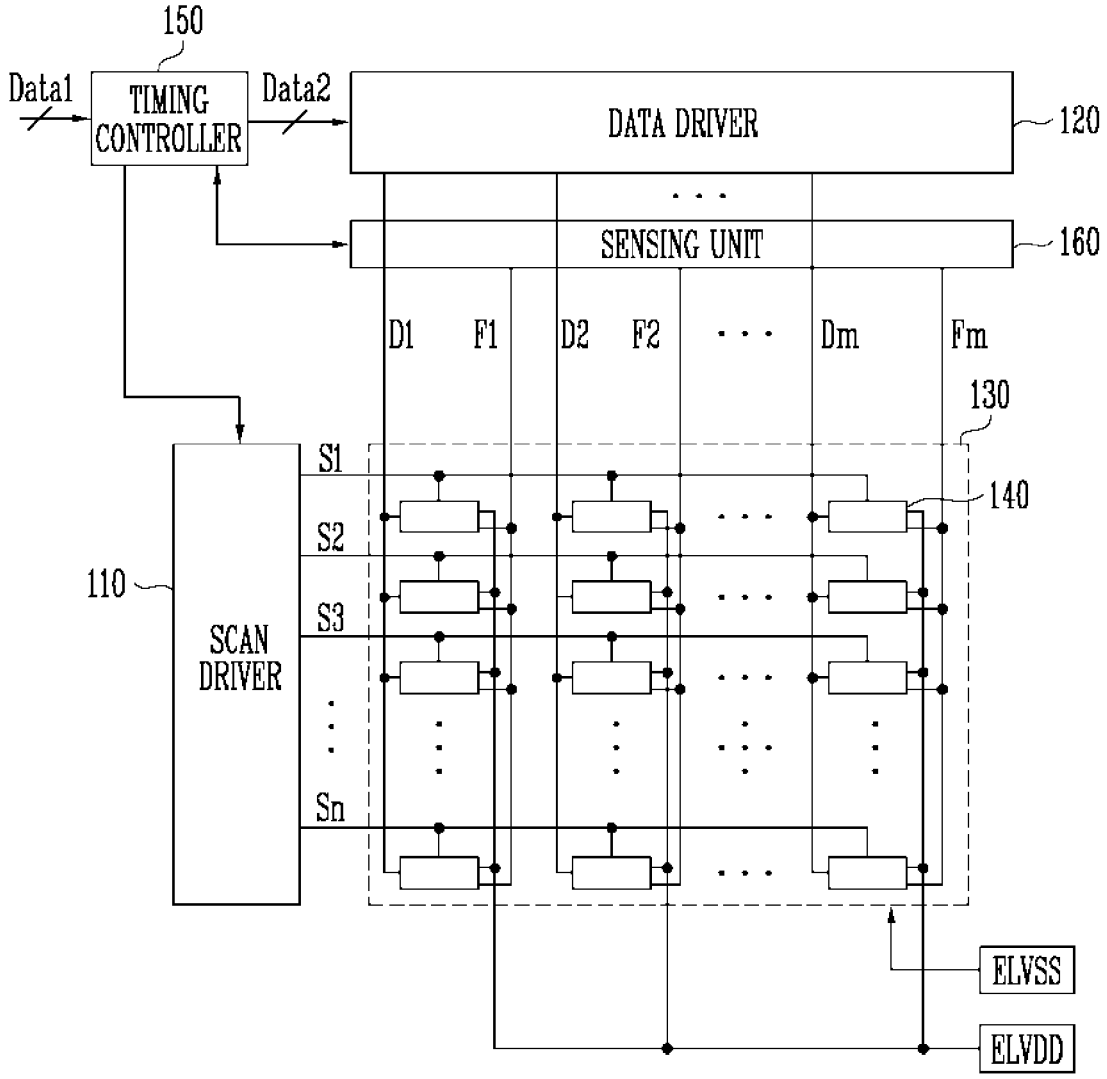
FIG. 1 is a diagram illustrating an organic light emitting display device according to an exemplary embodiment of the present disclosure.

Hereinafter, exemplary embodiments of the present invention and other matters required for make those skilled in the art easily understand the contents of the present invention will be described in detail with reference to the accompanying drawings. However, the present disclosure may be implemented in various suitable forms within the scope of the claims, so that the exemplary embodiment described below is for the illustrative purpose regardless of the expression.

In the following description, the same elements will be designated by the same reference numerals although they are shown in different drawings.

FIG. 1 is a diagram illustrating an organic light emitting display device according to an exemplary embodiment of the present disclosure.

Referring to FIG. 1, an organic light emitting display device, according to an exemplary embodiment of the present disclosure, includes a scan driver 110, a data driver 120, a display area 130, a timing controller 150, and a sensing unit (e.g., a sensor) 160.

The organic light emitting display device, according to the exemplary embodiment of the present disclosure, is driven based on a division of a sensing period and a driving period. The sensing period is a period in which deviation information (including a threshold voltage and/or mobility information) of a driving transistor included in each of pixels 140 is extracted, and the driving period is a period in which a set or predetermined image is displayed.

The scan driver 110 supplies a scan signal to scan lines S1 to Sn during the sensing period and the driving period in response to a control of the timing controller 150. For example, the scan driver 110 may sequentially supply a scan signal to the scan lines S1 to Sn. When the scan signal is sequentially supplied to the scan lines S1 to Sn, the pixels 140 are selected in the unit of a horizontal line. To this end, the scan signal is set with a gate-on voltage so that the transistor included in each of the pixels 140 may be turned on.

In addition, in the present disclosure, the scan signal supplied during the sensing period may be set with a first width, and the scan signal supplied during the driving period may be set with a second width different from the first width so that deviation information of the driving transistor may be accurately extracted. Here, the first width may be set larger than the second width.

The data driver 120 supplies a first reference data signal to the data lines D1 to Dm during the sensing period, for which deviation information of the driving transistor is extracted, in response to the control of the timing controller 150. Here, the first reference data signal is set with a voltage, at which a current may flow in the driving transistor. For example, the first reference data signal may be set with any one of the data lines which the data driver 120 may supply.

Further, the data driver 120 receives second data Data2 for the driving period, and generates a data signal based on the received second data Data2. Here, the second data Data2 may be set with various suitable values in response to an image, which the display area 130 desires to display. The data signal generated by the data driver 120 is supplied to the data lines D1 to Dm. The data signals supplied to the data lines D1 to Dm are supplied to the pixels 140 selected by the scan signals.

The display area 130 includes the pixels 140 positioned so as to be connected with the scan lines S1 to Sn, feedback lines F1 to Fm, and the data lines D1 to Dm. The display area 130 receives a first driving power source ELVDD and a second driving power source ELVSS from the outside.

Each of the pixels 140 includes a driving transistor and an organic light emitting diode which are not illustrated. The driving transistor controls the amount of current flowing from the first driving power source ELVDD to the second driving power source ELVSS via the organic light emitting diode OLED in response to the data signal. FIG. 1 illustrates only n scan lines S1 to Sn, but the present disclosure is not limited thereto. For example, one or more dummy scan lines may be additionally formed in the display area 130 based on a circuit structure of the pixels 140.

The sensing unit 160 extracts deviation information of the driving transistor included in each of the pixels 140 during the sensing period, and generates compensation data based on the extracted deviation information. The compensation data generated by the sensing unit 160 is stored in a memory by the timing controller 150 and the like. The compensation data is set so that the pixels 140 generate light with uniform brightness in response to the same data signal. To this end, the compensation data corresponding to all of the pixels 140 included in the display area 130 may be stored in the memory during the sensing period.

The timing controller 150 controls the scan driver 110, the data driver 120, and the sensing unit 160. Further, the timing controller 150 changes a bit value of first data Data1 input from the outside by using the compensation data stored in the memory and generates the second data Data2. Here, the second data Data2 is set so as to compensate for a deviation of the driving transistor.

Figure 2A:
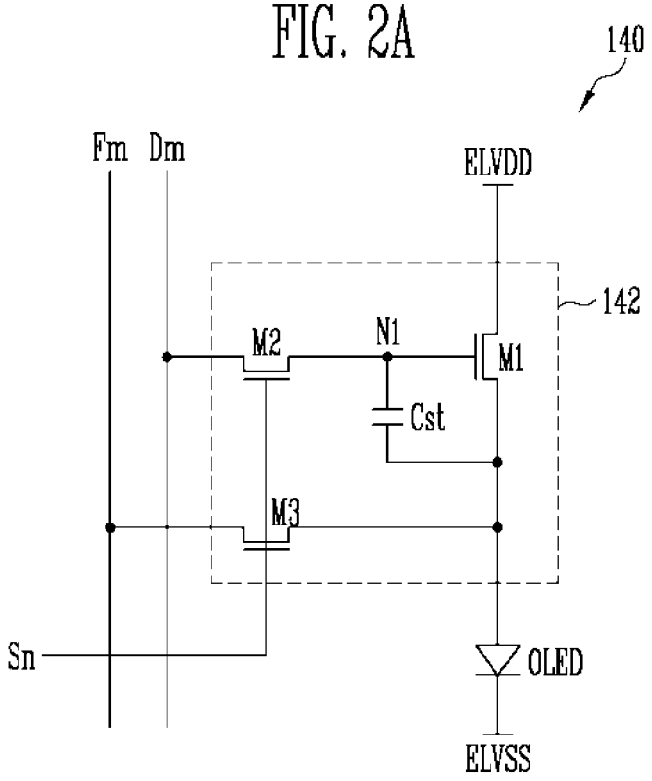
FIGS. 2A-2B are diagrams illustrating exemplary embodiments of a pixel illustrated in FIG. 1.

FIG. 2A is a diagram illustrating an exemplary embodiment of the pixel illustrated in FIG. 1. For convenience of description, FIG. 2A illustrates a pixel connected with an $n^{th}$ scan line Sn, an $m^{th}$ data line Dm, and an $m^{th}$ feedback line Fm.

Referring to FIG. 2A, the pixel 140 according to the exemplary embodiment of the present disclosure includes the organic light emitting diode OLED and a pixel circuit 142.

An anode electrode of the organic light emitting diode OLED is connected to the pixel circuit 142, and a cathode electrode is connected to a second driving power source ELVSS. The organic light emitting diode OLED emits light with set or predetermined brightness in response to the amount of current supplied from the pixel circuit 142.

The pixel circuit 142 controls the amount of current flowing from the first driving power source ELVDD to the second driving power source ELVSS via the organic light emitting diode OLED in response to the data signal. To this end, the pixel circuit 142 includes a first transistor M1 (a driving transistor), a second transistor M2, a third transistor M3, and a storage capacitor Cst.

A first electrode of the first transistor M1 is connected to the first driving power source ELVDD, and a second electrode thereof is connected to the anode electrode of the organic light emitting diode OLED. Further, a gate electrode of the first transistor M1 is connected to a first node N1. The first transistor M1 controls the amount of current flowing from the first driving power source ELVDD to the second driving power source ELVSS via the organic light emitting diode OLED in response to a voltage of the first node N1.

A first electrode of the second transistor M2 is connected to the data line Dm, and a second electrode thereof is connected to the first node N1. Further, a gate electrode of the second transistor M2 is connected to the scan line Sn. The second transistor M2 is turned on when the scan signal is supplied to the scan line Sn to electrically connect the data line Dm and the first node N1.

A first electrode of the third transistor M3 is connected to the second electrode of the first transistor M1, and a second electrode thereof is connected to the feedback line Fm. Further, a gate electrode of the third transistor M3 is connected to the scan line Sn. The third transistor M3 is turned on when the scan signal is supplied to the scan line Sn to electrically connect the feedback line Fm and the second electrode of the first transistor M1.

The storage capacitor Cst is connected between the first node N1 and the second electrode of the first transistor M1. The storage capacitor Cst stores a voltage of the first node N1.

Figure 2B:
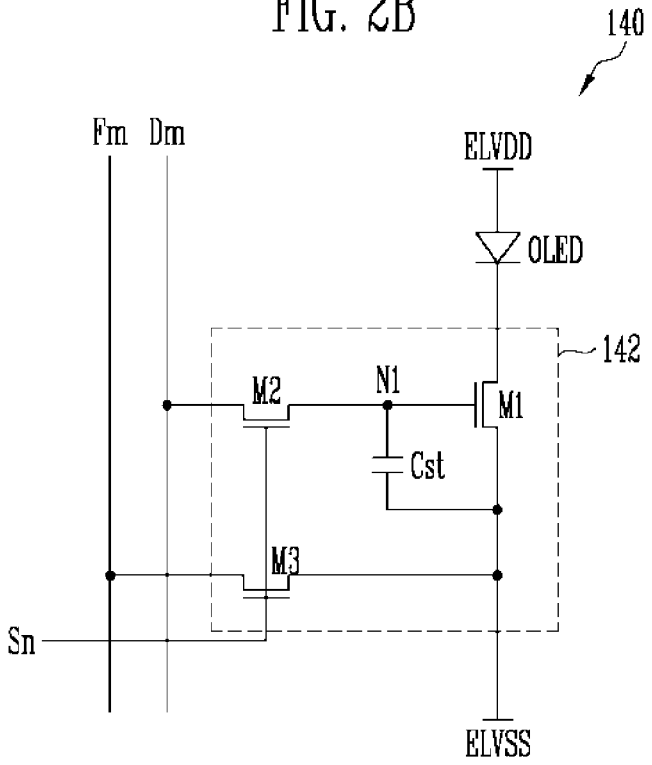

The circuit structure of the pixel 140 in the exemplary embodiment of the present disclosure is not limited to the circuit structure illustrated in FIG. 2A. For example, the organic light emitting diode OLED in the exemplary embodiment of the present disclosure may be positioned between the first driving power source ELVDD and the first transistor M1 as illustrated in FIG. 2B. That is, the pixel 140 in the exemplary embodiment of the present disclosure may be suitably changed so as to include the third transistor M3.

Figure 3:
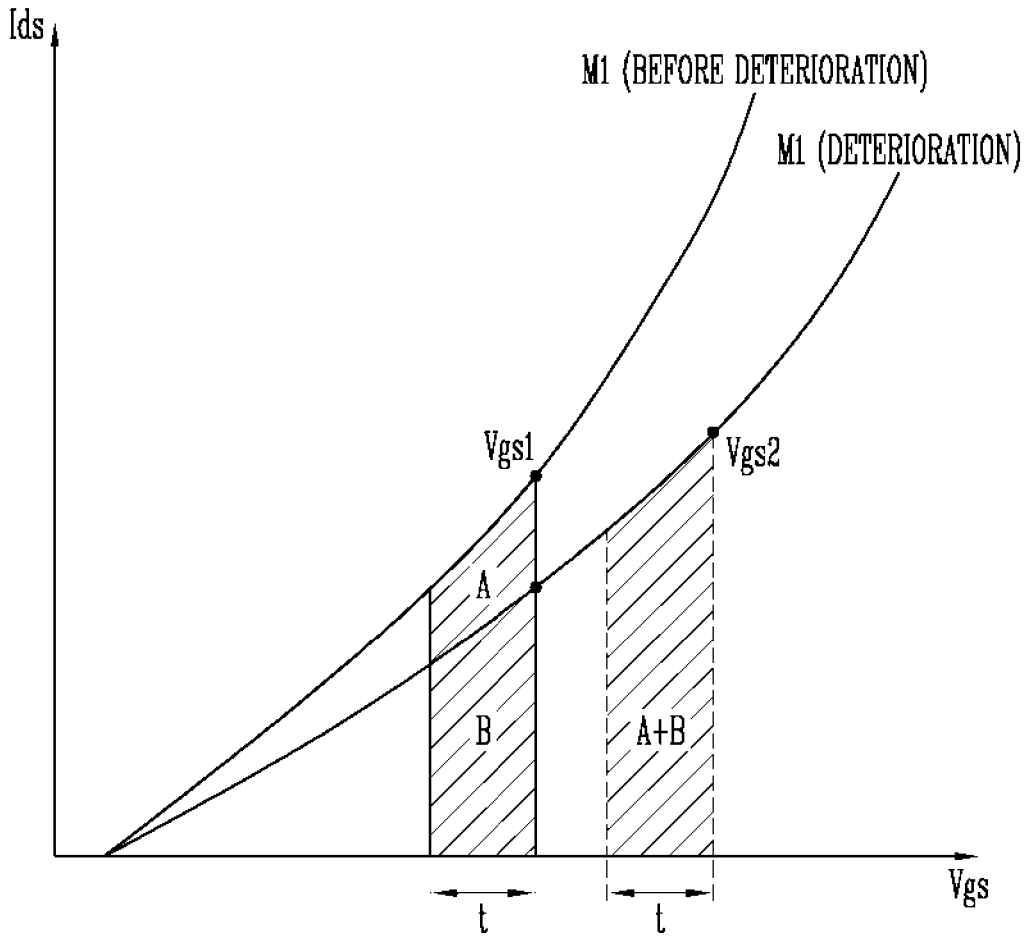
FIG. 3 is a diagram illustrating a deterioration characteristic of first transistors illustrated in FIGS. 2A and 2B.

FIG. 3 is a diagram illustrating a deterioration characteristic of the first transistors illustrated in FIGS. 2A and 2B.

Referring to FIG. 3, the first transistor M1 deteriorates as time goes on, and a characteristic thereof is changed as a result of the deterioration. For convenience of description, it is assumed that a voltage Vgs1 is applied between the gate electrode and a source electrode of the first transistor M1 in response to a voltage of the first reference data signal being applied during the sensing period. It is assumed that the sensing period is a time t.

Before the first transistor M1 deteriorates, a current corresponding to an area "A+B" flows in response to the voltage Vgs1. When the first transistor M1 deteriorates, a current corresponding to an area "B" flows in response to the voltage Vgs1. That is, the first transistor M1 supplies different currents in response to the application of the same first reference data signal, as a result of the deterioration.

To compensate for the deviation, the degree of deterioration of the first transistor M1 may be recognized by using the current corresponding to the area of "B", and a voltage of the data signal may be changed in response to the degree of deterioration. For example, the voltage of the first reference data signal may be changed so that a voltage Vgs2 is applied between the gate electrode and the source electrode of the first transistor M1. Here, the voltage Vgs2 refers to a voltage, at which the current corresponding to the area of "A+B" flows.

In the method, the voltage Vgs2 may be set by using the current corresponding to the area of "B". In this case, mobility and the like of the first transistor M1 may be considered, and thus complex equation and modeling process may be utilized. Further, when the deterioration of the first transistor M1 is compensated by the method, a real-time calculation operation may be enabled, and thus, a complex circuit configuration (that is, hardware) may have to be added.

Figure 4:
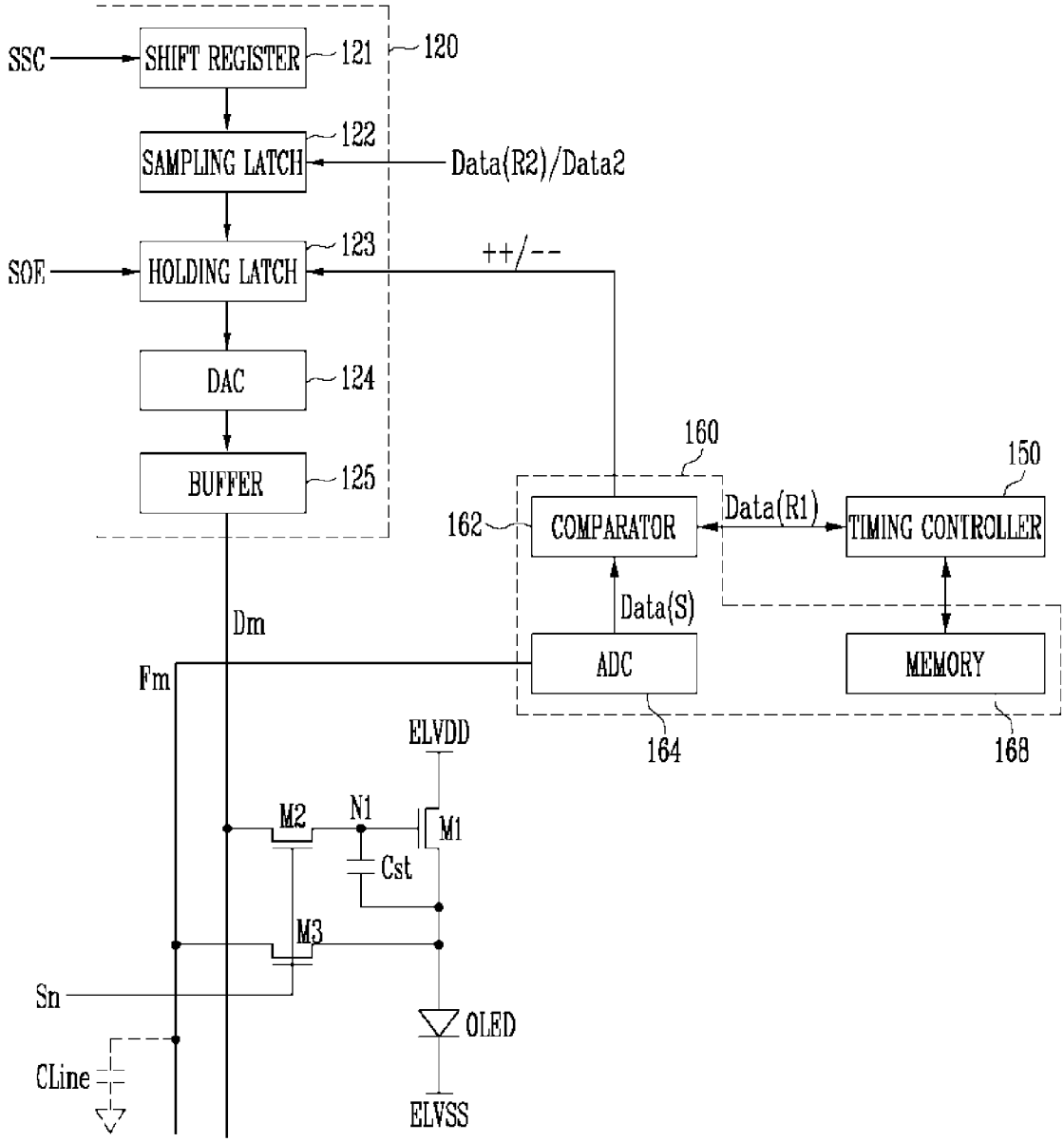
FIG. 4 is a diagram illustrating a data driver and a sensing unit according to an exemplary embodiment of the present disclosure.

FIG. 4 is a diagram illustrating a data driver and a sensing unit 160 according to an exemplary embodiment of the present disclosure. FIG. 4 illustrates the $m^{th}$ channel for convenience of description.

Referring to FIG. 4, the sensing unit 160 according to the exemplary embodiment of the present disclosure includes a comparator 162, an analog-digital converter (ADC) 164, and a memory 168.

The ADC 164 changes deviation information of the first transistor M1 supplied from the feedback line Fm to a digital (binary) value (for sensing data Data(S)).

Second reference data Data(R2) is used for generating the first reference data signal during the sensing period. That is, the second reference data Data(R2) is data for generating the first reference data signal, and may be selected with any one among data which may be supplied to the data driver 120.

First reference data Data(R1) is used for uniformly setting the characteristic of the first transistors M1 included in the pixels 140. That is, the first reference data Data(R1) corresponds a set or predetermined reference so that the characteristics of the first transistors M1 correspond to (e.g., match or substantially match) one another.

Here, the first reference data Data(R1) may be pre-set before forwarding to the organic light emitting display device (e.g., from the outside or a source external to the organic light emitting display device). In some examples, the first reference data Data(R1) may be set according to the characteristic of the driving transistor M1 included in the pixel 140 positioned at a center of the display area 130. In some examples, the first reference data Data(R1) may be set in correspondence with an average value of the characteristic of the first transistors M1 included in the display area 130.

When the sensing process is performed, sensing data Data(S) corresponding to the characteristic of the first transistor M1 included in each of the pixels in the display area 130 may be extracted. Here, the sensing data Data(S) of the first transistor M1 positioned at the center of the display area 130 may be set as the first reference data Data(R1). In some examples, an average value of the sensing data Data(S) of the first transistors may be calculated, and the calculated average value may be set as the first reference data Data (R1).

The comparator 162 compares the sensing data Data(S) from the ADC 164 and the first reference data Data(R1) from the timing controller 150, and controls a bit value of the second reference data Data(R2) stored in a holding latch 123 in response to a result of the comparison. For example, the comparator 162 may change the second reference data Data(R2) so that the sensing data Data(S) corresponds to (e.g., is similar to or the same as) the first reference data Data(R1) in response to the result of the comparison.

A value of the first reference data Data(R1) is stored in the memory 168. Further, the compensation data, with which the characteristics of the first transistors M1 may be compensated, are stored in the memory 168. Here, the compensation data may be set with a change value of the second reference data Data(R2). This will be described in further detail below. The compensation data is stored in the memory 168 during the sensing period. For example, the compensation data corresponding to all of the pixels 140 may be stored in the memory 168 during the sensing period.

The data driver 120 according to the exemplary embodiment of the present disclosure includes a shift register 121, a sampling latch 122, a holding latch 123, a digital-analog converter (DAC) 124, and a buffer 125.

The shift register 121 supplies a sampling signal to the sampling latch 122. For example, the plurality of shift registers may shift a source start pulse for every 1 period of a source shift clock SSC and sequentially supply m sampling signals.

The sampling latch 122 stores data supplied from the timing controller 150 in response to the sampling signal. Here, the sampling latch 122 may store the second reference data Data(R2) during the sensing period. Further, the sampling latch 122 may store the second data Data2 for the driving period.

In addition, the plurality of sampling latches stores the second reference data Data(R2) during the sensing period. Further, the plurality of sampling latches stores the second data Data2 for the driving period. Here, the second data Data2 corresponds to the image, which the display area 130 desires to display, and the second data Data2 of the different bits may be stored in each of the plurality of sampling latches.

The holding latch 123 receives and stores the data stored in the sampling latch 122 in response to a source output enable (SOE) signal. In this case, the holding latch 123 may store the second reference data Data(R2) during the sensing period.

The DAC 124 generates an analog data signal based on the data supplied from the holding latch 123. That is, the DAC 124 controls a voltage of the data signal so that a gray value is implemented in response to a bit value of the data supplied to the holding latch 123. In addition, the DAC 124 generates the first reference data signal in response to the second reference data Data(R2) during the sensing period.

The buffer 125 supplies the data signal supplied from the DAC 124 to the data line Dm.

Figure 5A:
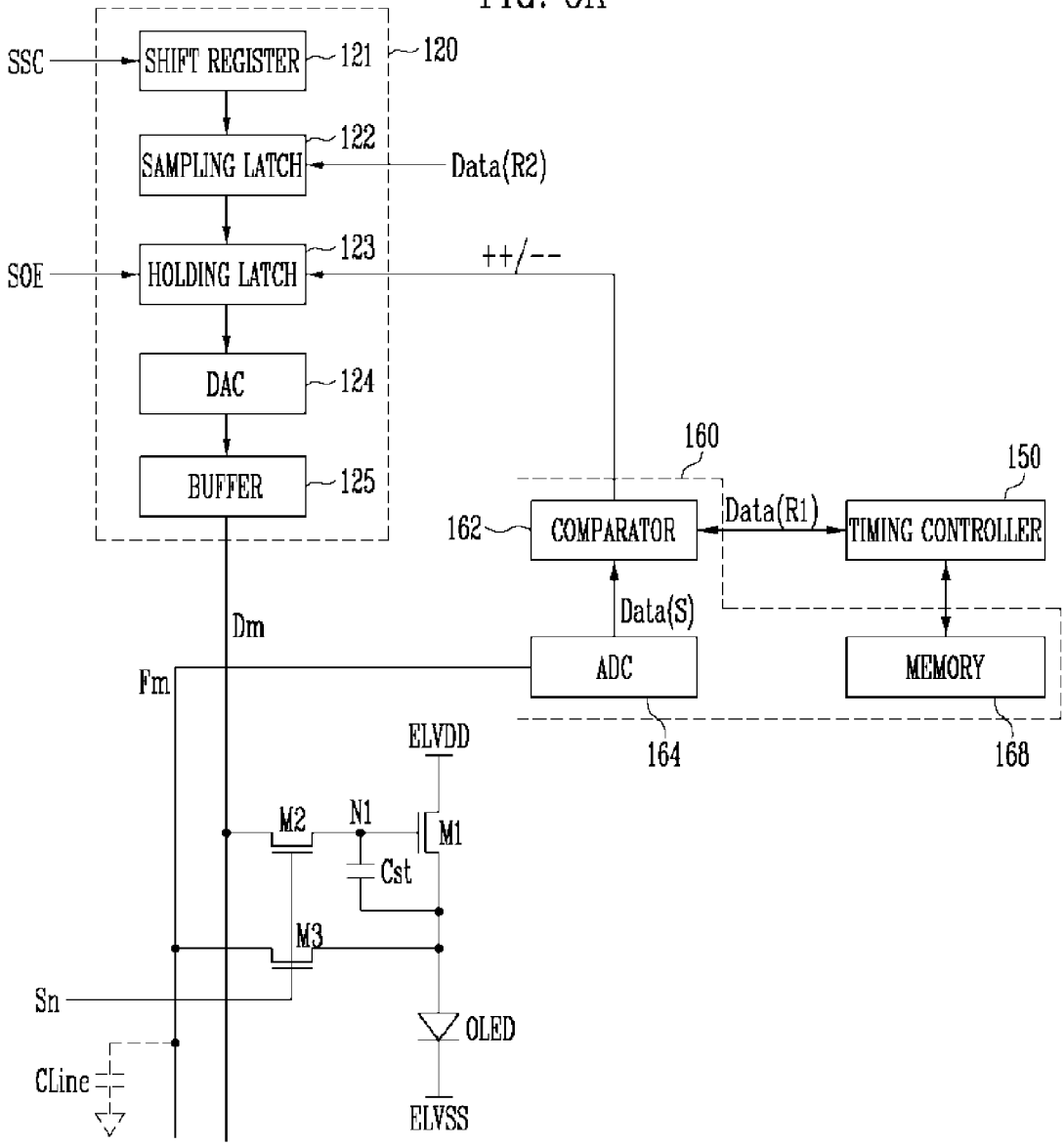
FIGS. 5A-5B are diagrams illustrating an operation of the data driver and the sensing unit during a sensing period according to an exemplary embodiment of the present disclosure.
Figure 5B:
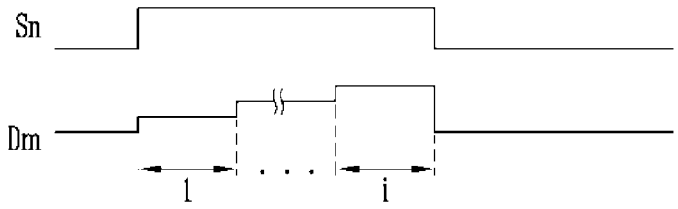

FIGS. 5A to 5B are diagrams illustrating an operation of the data driver 120 and the sensing unit 160 during the sensing period according to the exemplary embodiment of the present disclosure. The operation will be described based on the $m^{th}$ channel with reference to FIGS. 5A-5B.

Referring to FIGS. 5A-5B, first, the sampling latch 122 stores the second reference data Data(R2) in response to the sampling signal from the shift register 121 during the sensing period.

The holding latch 123 receives the second reference data Data(R2) from the sampling latch 122 in response to the source output enable (SOE) signal and stores the received second reference data Data(R2). The DAC 124 generates the first reference data signal based on the second reference data Data(R2) stored in the holding latch 123. The first reference data signal generated in the DAC 124 is supplied to the data line Dm via the buffer 125.

The scan signal is supplied to the scan line Sn during the sensing period. When the scan signal is supplied to the scan line Sn, the second transistor M2 and the third transistor M3 are turned on. When the third transistor M3 is turned on, the feedback line Fm and the second electrode of the first transistor M1 are electrically connected. When the second transistor M2 is turned on, the data line Dm and the first node N1 are electrically connected. Then, the first reference data signal from the data line Dm is supplied to the first node N1.

After the first reference data signal is supplied to the first node N1, a set or predetermined current corresponding to the first reference data signal is supplied to the feedback line Fm by the first transistor M1 via the third transistor M3.

Here, the feedback line Fm may include a set or predetermined resistance, and thus, a voltage corresponding to the set or predetermined current is applied to the feedback line Fm. The voltage applied to the feedback line Fm is stored in a line capacitor Cline, which is parasitically formed in the feedback line Fm.

Here, the voltage stored in the line capacitor Cline includes deviation information of the first transistor M1. The current flowing from the first transistor M1 in response to the first reference data signal is determined in response to a threshold voltage, mobility, and deterioration of the first transistor M1. That is, the voltage stored in the line capacitor Cline during the sensing period may be differently set in each of the pixels 140 in response to the threshold voltage, the mobility, and the deterioration of the first transistor M1.

The ADC 164 changes the voltage stored in the line capacitor Cline to the sensing data Data(S). The comparator 162 compares the first reference data Data(R1) supplied from the timing controller 150 and the sensing data Data(S) supplied from the ADC 164. Further, the comparator 162 controls a bit value of the second reference data Data(R2) stored in the holding latch 123 so that the sensing data Data(S) corresponds to (e.g., is similar to or the same as) the first reference data Data(R1). For example, the comparator 162 may add or subtract a set or predetermined value so that the sensing data Data(S) corresponds to (e.g., is similar to or the same as) the first reference data Data(R1).

When a bit value of the second reference data Data(R2) is changed, a voltage of the first reference data signal generated in the DAC 124 is also changed. Then, the current flowing from the first transistor M1 according to the first reference data signal and a voltage stored in the line capacitor Cline in response to the current are also changed. Then, finally, the sensing data Data(S) is changed in response to the change of the bit value of the second reference data Data(R2).

In the exemplary embodiment of the present disclosure, the comparator 162 changes the bit value of the second reference data Data(R2) i times or more (herein, i is a natural number equal to or larger than 2) during the sensing period so that the sensing data Data(S) corresponds to (e.g., is similar to or the same as) the first reference data Data(R1). When the bit value of the second reference data Data(R2) is changed i times or more, the sensing data Data(S) may be similar to or the same as the first reference data Data(R1).

Finally, the changed bit value of the second reference data Data(R2) is stored in the memory 168 as compensation data. That is, through the sensing process, the compensation data corresponding to all of the pixels 140 may be stored in the memory 168.

The compensation data refers to a changing value of the second reference data Data(R2), and when the compensation data is applied to the second reference data Data(R2) (for example, is added to or is subtracted from), the sensing data Data(S) may be similar to or the same as the first reference data Data(R1).

Accordingly, when a bit value of the data to be supplied to each of the pixels 140 is change by using the compensation data corresponding to each of the pixels 140, each of the pixels 140 may generate light with the similar or same brightness in respond to the same data signal.

In the exemplary embodiment of the present disclosure, the compensation data is set with the changing value of the second reference data Data(R2), which is changed i times or more during the sensing period. In this case, the equation and the circuit configuration for the modelling may be omitted.

The sensing period according to the exemplary embodiment of the present disclosure may be included at least one time before the forwarding to the organic light emitting display device(e.g., forwarding from the outside or a source external to the organic light emitting display device). Then, the compensation data corresponding to the deviation of the first transistor M1 included in each of the pixels 140 is stored in the memory 168, and thus, the display area 130 may display an image with uniform brightness.

Further, the sensing period according to the exemplary embodiment of the present disclosure may be set to be initiated based on a use time of the organic light emitting display device. For example, the sensing period may be set to be included in every predetermined time (e.g., the sensing period may be repeated at a regular interval) in response to the deterioration of the first transistor M1. In addition, the sensing period may be set to be included at a time, at which power is input into a panel and/or a time, at which a power supply is off. That is, the sensing period according to the exemplary embodiment of the present disclosure may be variously and suitably included so as not to be recognized by a user or an observer of the panel.

Figure 6A:
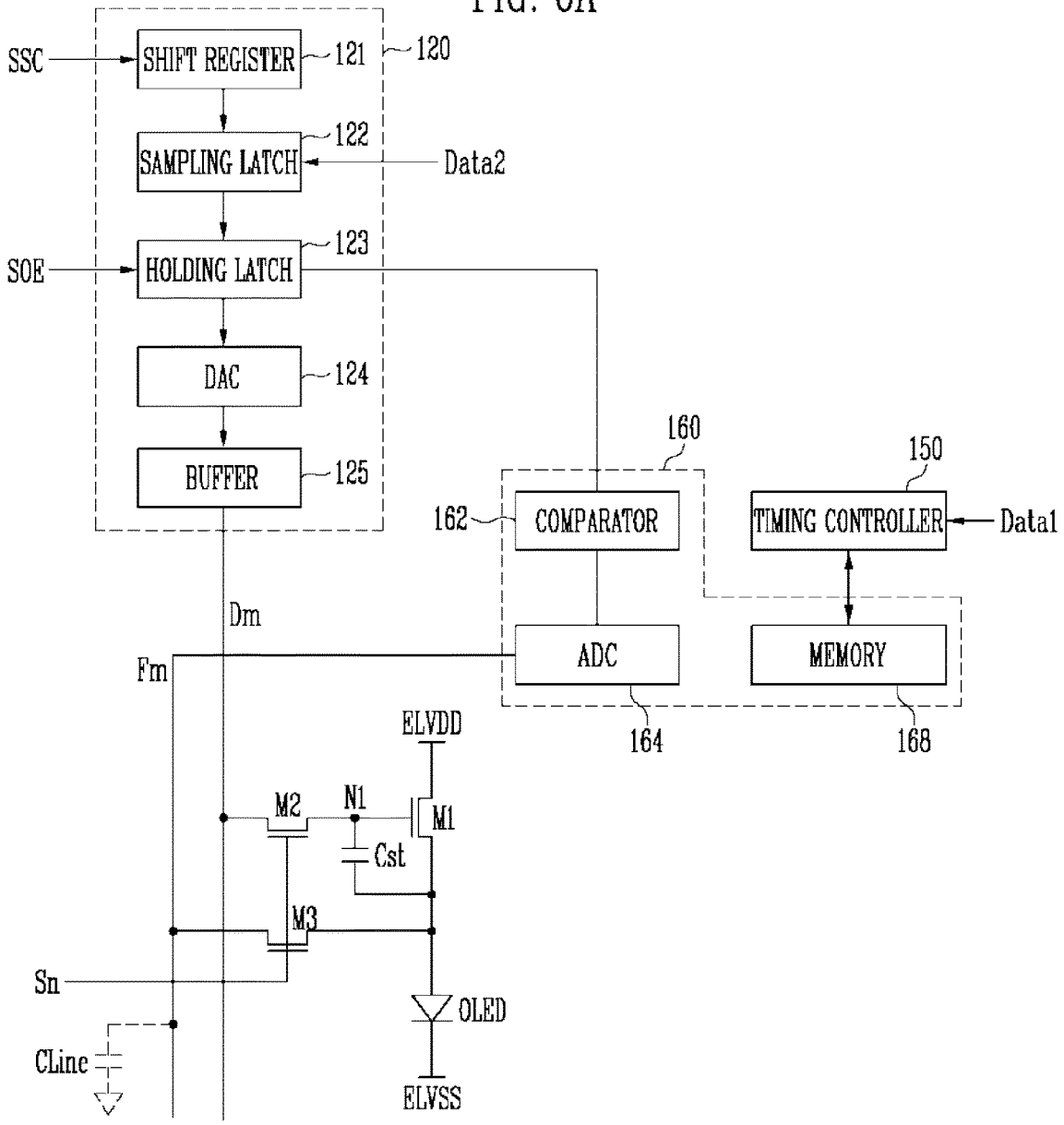
FIGS. 6A-6B are diagrams illustrating an operation of the data driver and the sensing unit during a driving period according to an exemplary embodiment of the present disclosure.
Figure 6B:
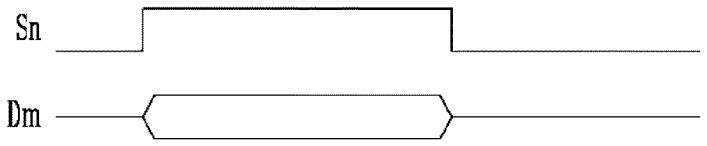

FIGS. 6A-6B are diagrams illustrating an operation of the data driver 120 and the sensing unit 160 during the driving period according to the exemplary embodiment of the present disclosure. The operation will be described based on the $m^{th}$ channel with reference to FIGS. 6A-6B.

Referring to FIGS. 6A-B, first, the timing controller 150 receives the first data Data1 from the outside during the driving period. The timing controller 150 receiving the first data Data1 changes a bit value of the first data Data1 by using the compensation data stored in the memory 168 and generates the second data Data2. Here, the second data Data2 to be supplied to a specific pixel may be generated by adding or subtracting compensation data extracted from the specific pixel to or from the first data Data1 to be supplied to the specific pixel.

The sampling latch 122 stores the second data Data2 in response to the sampling signal from the shift register 121 during the driving period. The holding latch 123 receives the second data Data2 from the sampling latch 122 in response to the source output enable (SOE) signal and stores the received second data Data2. The DAC 124 generates a data signal based on the second data Data2 stored in the holding latch 123. The data signal generated in the DAC 124 is supplied to the data line Dm via the buffer 125.

The scan signal is supplied to the scan line Sn during the driving period. When the scan signal is supplied to the scan line Sn, the second transistor M2 and the third transistor M3 are turned on.

When the second transistor M2 is turned on, the data line Dm and the first node N1 are electrically connected. Then, the data signal from the data line Dm is supplied to the first node N1. The first transistor M1 controls the amount of current flowing from the first driving power source ELVDD to the second driving power source ELVSS via the organic light emitting diode OLED in response to the data signal. In this case, the organic light emitting diode OLED generates light with set or predetermined brightness according to the amount of current.

The data signal supplied during the driving period in the exemplary embodiment of the present disclosure is generated by the second data Data2, and thus the display area 130 may display an image with uniform brightness.

In addition, when the third transistor M3 is turned on, the feedback line Fm and the second electrode of the first transistor M1 are electrically connected. In this case, the ADC 164 and the comparator 162 do not perform separate operations. Accordingly, the bit value of the data stored in the holding latch 123 is not change for the driving period.

Figure 7:
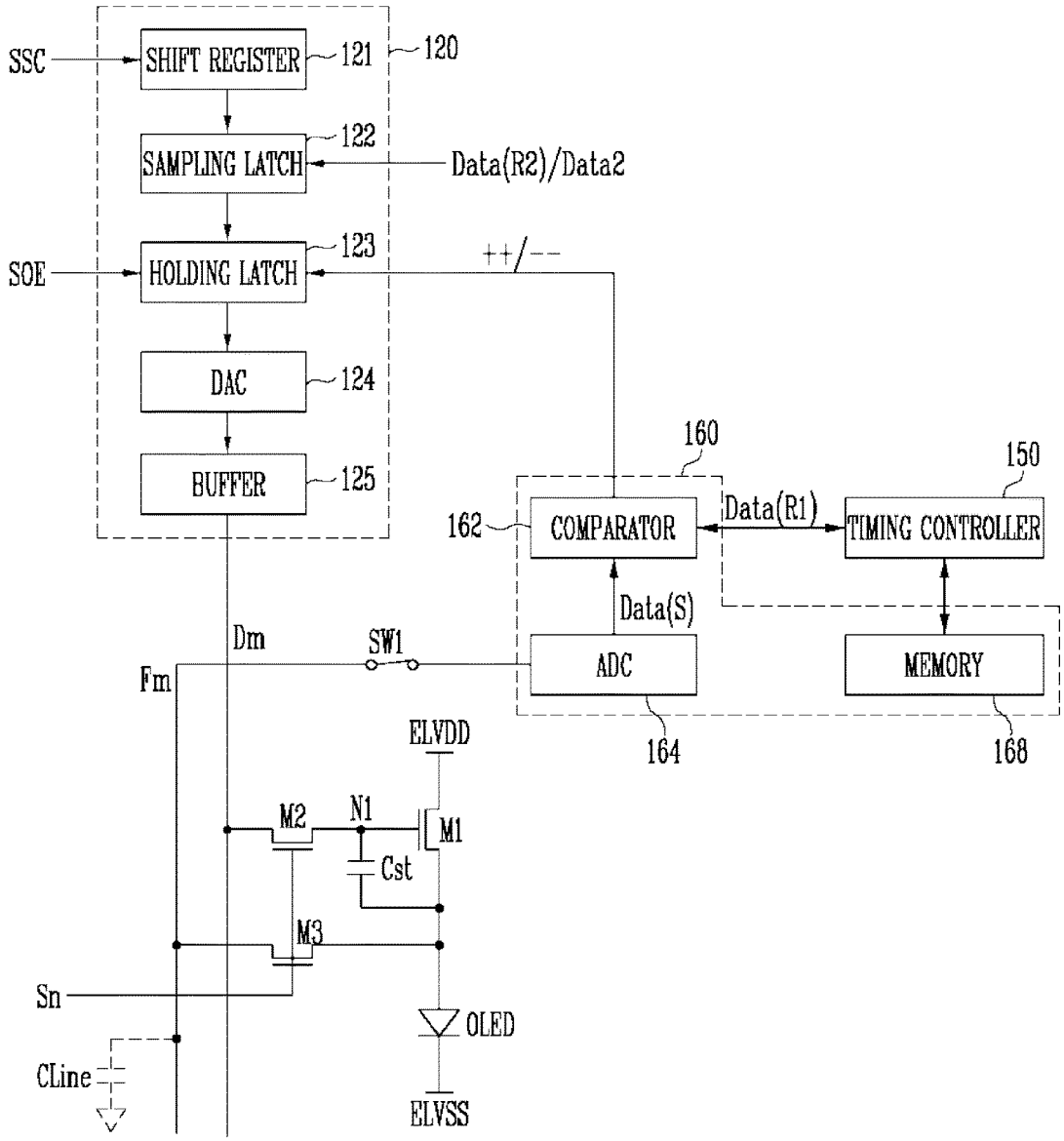
FIG. 7 is a diagram illustrating a data driver and a sensing unit according to another exemplary embodiment of the present disclosure.

FIG. 7 is a diagram illustrating a data driver and a sensing unit 160 according to another exemplary embodiment of the present disclosure. In describing FIG. 7, the same configuration as that of FIG. 4 is denoted with the same reference numeral, and a detailed description thereof may not be repeated.

Referring to FIG. 7, in another exemplary embodiment of the present disclosure, a first switch SW1 connected between a sensing unit 160 and a feedback line FM is additionally provided. Here, the first switch SW1 may be formed to be connected to each of the feedback lines F1 to Fm.

The first switch SW1 is turned on during a sensing period and is turned off during a driving period. In this case, an unnecessary voltage may not be supplied to an ADC 164 during the driving period, thereby improving reliability of the driving.

Figure 8:
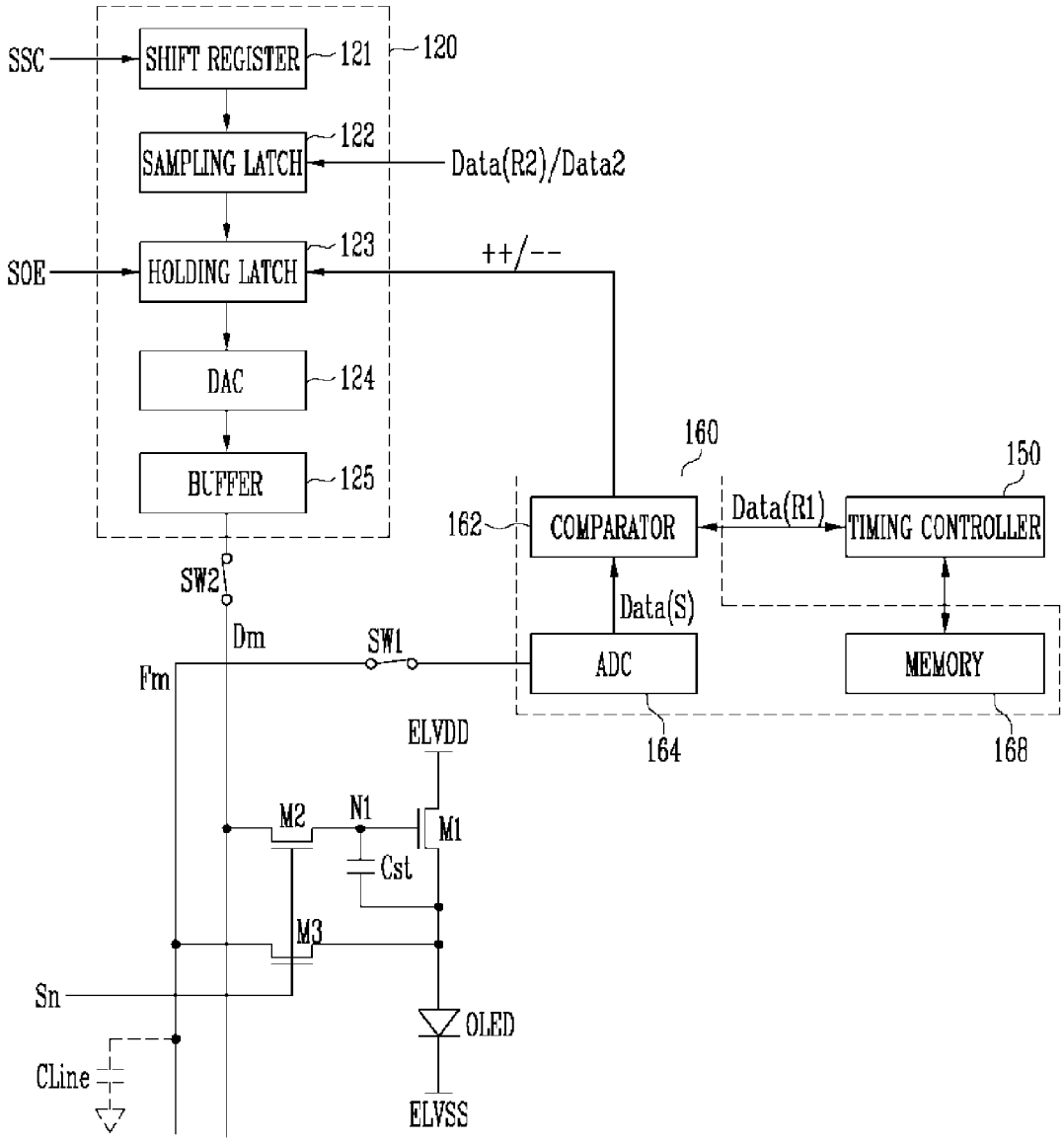
FIG. 8 is a diagram illustrating a data driver and a sensing unit according to yet another exemplary embodiment of the present disclosure.

FIG. 8 is a diagram illustrating a data driver 120 and a sensing unit 160 according to yet another exemplary embodiment of the present disclosure. In describing FIG. 8, the same configuration as that of FIG. 7 is denoted with the same reference numeral, and a detailed description thereof may not be repeated.

Referring to FIG. 8, in yet another exemplary embodiment of the present disclosure, a second switch SW2 connected between a data driver 120 and a data line Dm is additionally provided. Here, the second switch SW2 may be formed to be connected to each of the data lines D1 to Dm.

The second switch SW2 maintains a turn-on state during a sensing period and a driving period. The second switch SW2 may be added for a separate control operation and the like.

Figure 9:
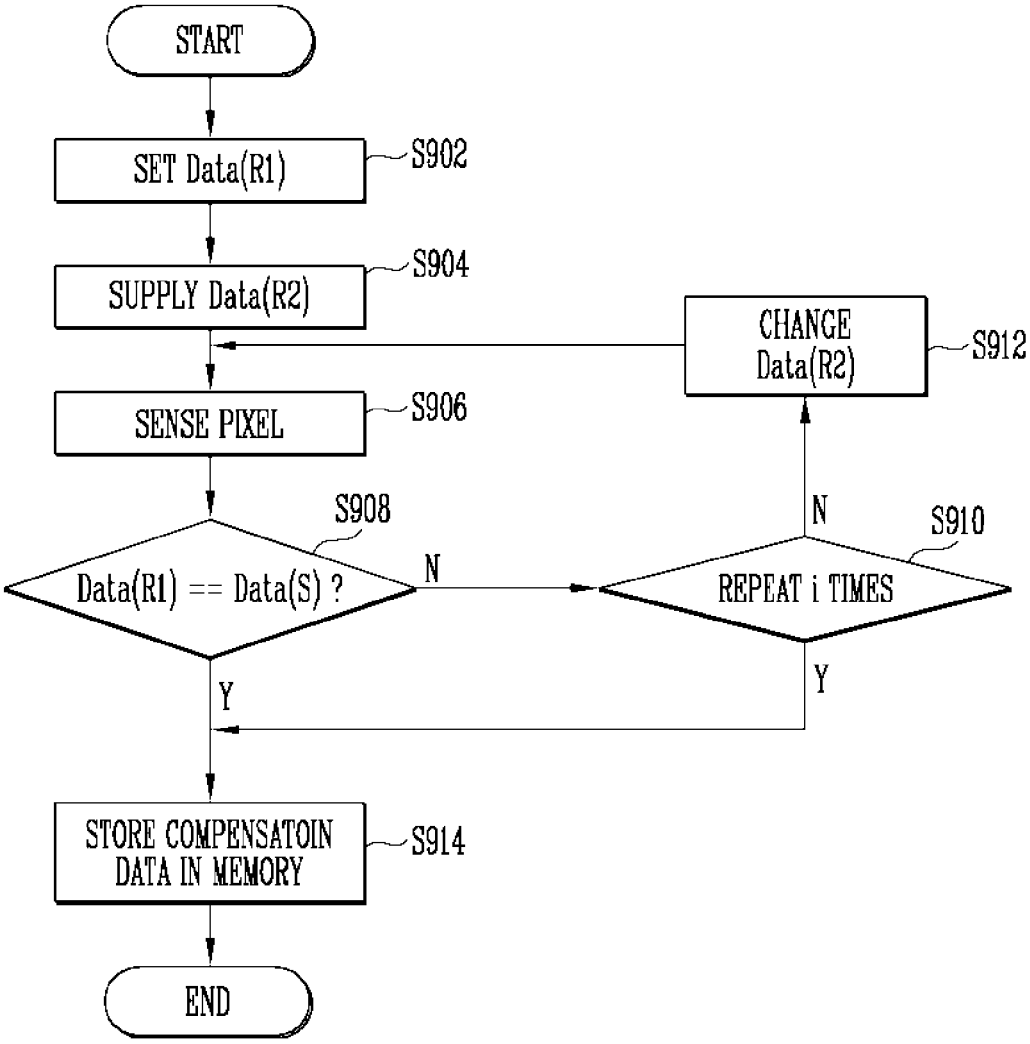
FIG. 9 is a diagram illustrating an operation performed during a sensing period according to an exemplary embodiment of the present disclosure.

FIG. 9 is a diagram illustrating an operation performed during the sensing period according to an exemplary embodiment of the present disclosure. The driving method will be described based on one channel with reference to FIG. 9.

<Set First Reference Data Data(R1): S902>

First, first reference data Data(R1) is set. Here, the first reference data Data(R1) corresponds to a predetermined reference so that the characteristics of the pixels 140 become uniform.

The first reference data Data(R1) may be pre-set with a value (e.g., an ideal value) before the forwarding to the organic light emitting display device (e.g., forwarding from the outside or a source external to the organic light emitting display device). Further, the first reference data Data(R1) may be set based on the characteristic of the driving transistor M1 included in the pixel 140 positioned at a center of the display area 130. Further, the first reference data Data (R1) may be set in correspondence with a characteristic average value of the first transistors M1 included in the display area 130.

<Supply Second Reference Data Data(R2): S904>

After the first reference data Data(R1) is set, the second reference data Data(R2) is supplied to the data driver 120. The data driver 120 receiving the second reference data Data(R2) generates first reference data signal based on the second reference data Data(R2). The first reference data signal generated in the data driver 120 is supplied to the data line.

<Sense Pixel: S906>

The pixel 140 receives the first reference data signal supplied in operation S904. When the first reference data signal is supplied to the pixel 140, the first transistor M1 supplies a current corresponding to the first reference data signal to the feedback line Fm. In this case, the voltage applied to the feedback line Fm in response to the current is changed to sensing data Data(S) that is a digital (e.g., a binary) value.

<Compare and Store First Reference Data and Sensing Data: S908, S910, S912, and S914>

Then, the comparator 162 compares the first reference data Data(R1) and the sensing data Data(S), and changes a bit value of the second reference data Data(R2) based on a result of the comparison. Actually, the comparator 162 may change the bit value of the second reference data Data(R2) while repeating operations S904 to S912 i times or more during the sensing period.

When the first reference data Data(R1) is the same as the sensing data Data(S) in operation S908, the changed bit value of the second reference data Data(R2) is stored in the memory 168 as the compensation data. Further, when the bit value of the second reference data Data(R2) is changed i times or more in operation S910, the changed bit value is stored in the memory 168 as the compensation data.

The compensation data of each of the pixels 140 may be stored in the memory 168 while repeating the aforementioned process in each of the channels during the sensing period according to the exemplary embodiment of the present disclosure.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer or element is referred to as being "between" two layers or elements, it can be the only layer or element between the two layers or elements, or one or more intervening layers or elements may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The organic light emitting display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the organic light emitting display device may be formed on one integrated circuit (IC) chip or on separate IC chips. Further, the various components of the organic light emitting display device may be implemented on a flexible printed circuit film, a tape carrier package (TCP), a printed circuit board (PCB), or formed on a same substrate. Further, the various components of the organic light emitting display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The technical spirit of the present disclosure has been described according to exemplary embodiments, but the exemplary embodiments are described herein for purposes of illustration and do not limit the present disclosure. Further, those skilled in the art will appreciate that various suitable modifications may be made without departing from the scope and spirit of the present disclosure as defined by the accompanying claims and equivalents thereof.

What is claimed is:

1. An organic light emitting display device comprising:

one or more pixels connected to scan lines, feedback lines, and data lines, and comprising driving transistors configured to control an amount of current supplied to organic light emitting diodes;

a sensor configured to generate compensation data based on sensing data comprising deviation information of a driving transistor of the driving transistors and first reference data for a sensing period;

a data driver configured to supply a first reference data signal to the data line based on second reference data for the sensing period; and a scan driver configured to supply a scan signal to the scan line, wherein the sensor is configured to generate the compensation data while changing a bit value of the second reference data two or more times during the sensing period.

2. The organic light emitting display device of claim 1, wherein the compensation data is set with a changed bit value of the second reference data.

3. The organic light emitting display device of claim 1, wherein the deviation information of the driving transistor is a voltage applied to the feedback line in response to a current flowing from the driving transistor when the first reference data signal is supplied.

4. The organic light emitting display device of claim 1, wherein when the second reference data is changed, a voltage of the first reference data signal is also changed.

5. The organic light emitting display device of claim 4, wherein the sensor is configured to change the bit value of the second reference data so that the sensing data corresponds to the first reference data.

6. The organic light emitting display device of claim 1, wherein the first reference data is pre-set before being forwarding to the organic light emitting display device.

7. The organic light emitting display device of claim 1, wherein a display area comprises a plurality of pixels, and the first reference data corresponds to a characteristic of a driving transistor of a pixel positioned at a center of the display area.

8. The organic light emitting display device of claim 1, wherein a display area comprises a plurality of pixels, and the first reference data corresponds to an average value of characteristics of driving transistors of the pixels.

9. The organic light emitting display device of claim 1, further comprising:

a timing controller configured to generate second data by changing a bit value of first data based on the compensation data for a driving period, during which a predetermined image is displayed, the first data being supplied from outside the organic light emitting display device.

10. The organic light emitting display device of claim 9, wherein the scan driver supplies a scan signal with a first width during the sensing period, and supplies a scan signal with a second width smaller than the first width during the driving period.

11. The organic light emitting display device of claim 9, wherein the sensor comprises:

an analog-digital converter configured to generate the sensing data based on the deviation information of the driving transistor; and a comparator configured to compare the first reference data supplied from the timing controller and the sensing data, and to change the bit value of the second reference data so that the sensing data corresponds to the first reference data.

12. The organic light emitting display device of claim 11, wherein the sensor further comprises a memory configured to store the first reference data and the compensation data.

13. The organic light emitting display device of claim 9, further comprising:

a first switch connected between the feedback line and the sensor, and configured to turn on during the sensing period and to turn off during the driving period.

14. The organic light emitting display device of claim 9, further comprising:

a second switch connected between the data driver and the data line, and configured to turn on during the sensing period and the driving period.

15. The organic light emitting display device of claim 1, wherein the data driver comprises:

a shift register configured to generate a sampling signal;

a sampling latch configured to store the second reference data in response to the sampling signal;

a holding latch configured to receive the second reference data stored in the sampling latch in response to a source output enable signal and to store the received second reference data; and a digital-analog converter configured to generate the first reference data signal by using the second reference data, wherein the sensor is configured to change the bit value of the second reference data stored in the holding latch during the sensing period.

16. A method of driving an organic light emitting display device configured to compensate for a characteristic of a driving transistor of a pixel during a sensing period, and to implement a predetermined image during a driving period, wherein, during the sensing period, the method comprises:

generating a first reference data signal in response to second reference data;

supplying the first reference data signal to a driving transistor of a pixel;

changing a voltage corresponding to a current flowing from the driving transistor of the pixel to sensing data that is a digital value;

comparing the sensing data and the first reference data, and changing a bit value of the second reference data two or more times so that the sensing data corresponds to the first reference data; and storing a changed bit value of the second reference data as compensation data.

17. The method of claim 16, further comprising:

changing a bit value of data to be supplied to the pixel based on the compensation data extracted from the driving transistor of the pixel for the driving period.

* * * * *